US008176836B2

(12) United States Patent
Peev

(10) Patent No.: US 8,176,836 B2
(45) Date of Patent: May 15, 2012

(54) DOUBLE ACTION SHORT RESET TRIGGER SYSTEM

(76) Inventor: Vladimir Georgiev Peev, Sofia (BG)

( * ) Notice: Subject to any disclaimer, the term of this patent is extended or adjusted under 35 U.S.C. 154(b) by 137 days.

(21) Appl. No.: 12/743,381

(22) PCT Filed: Nov. 21, 2008

(86) PCT No.: PCT/BG2008/000024

§ 371 (c)(1),
(2), (4) Date: May 18, 2010

(87) PCT Pub. No.: WO2009/065196

PCT Pub. Date: May 28, 2009

(65) Prior Publication Data

US 2011/0099870 A1 May 5, 2011

(30) Foreign Application Priority Data

Nov. 23, 2007 (BG) ..... 110001

(51) Int. Cl.
*F41A 19/13* (2006.01)

(52) U.S. Cl. ..... 89/147; 42/69.02

(58) Field of Classification Search ..... 42/69.02; 89/136, 147

See application file for complete search history.

(56) References Cited

U.S. PATENT DOCUMENTS

| | | | | |
|---|---|---|---|---|
| 2,787,000 | A * | 4/1957 | Smith et al. | 227/9 |
| 4,539,889 | A | 9/1985 | Glock | |
| 4,825,744 | A | 5/1989 | Glock | |
| 4,893,546 | A | 1/1990 | Glock | |
| 5,355,768 | A | 10/1994 | Felk | |
| 6,665,973 | B1 * | 12/2003 | Peev | 42/69.01 |
| 7,353,742 | B1 * | 4/2008 | Sirkis et al. | 89/196 |

* cited by examiner

*Primary Examiner* — Stephen M Johnson
(74) *Attorney, Agent, or Firm* — Brown & Michaels, PC

(57) ABSTRACT

The mechanism is simple, with longer service life, and allows for a safe carrying for prolonged periods and quick subsequent shots of the firearms. The striker (1) has a middle enlargement (1*b*) that is closer to the front enlargement (1*c*). The rear face of the middle enlargement (1*b*) serves as a forward rest for the mainspring (4). The forward face is a rear rest for the safety spring (5) with its front part resting on the rear face of the axially floating ring (3) with an internal diameter smaller than the external diameter of the front (1*c*) and middle (1*b*) enlargements. The external diameter is greater than the internal diameter of the front enlargement (1*c*). Between the rear part of the mainspring (4) and the bushing (6) there is a second axially floating ring (2) with an internal diameter smaller than the external diameter of the rear (1*a*) and middle (1*b*) enlargements. The spring (12) that returns the trigger (10) is pushing the trigger (10) forward and the trigger bar (14) up.

4 Claims, 14 Drawing Sheets

DOUBLE ACTION SHORT RESET TRIGGER SYSTEM

FIELD OF THE INVENTION

The Double Action Short Reset Striker-Trigger System is intended for be used in any type of firearm.

PRIOR ART OF THE INVENTION

The known trigger mechanism intended for use in hand-held firearms can be divided into two broad groups: using either a hammer or a striker. The first type is the trigger mechanisms with a hammer [1]. The trigger mechanisms of that type consists of a hammer mechanism that is connected to a trigger. The hammer mechanism consists of a hammer that is engaged by a mainspring. The hammer, acted upon by the mainspring, pivots and strikes on a firing pin, which flies forward and hits the primer of a chambered round, producing a shot. This type of trigger mechanism is divided into three sub-types—single action, single and double action, and double action only.

In the single action trigger mechanisms [2] the cocking of the hammer for the first shot is done only by either cycling the bolt carrier or slide, or manually, by pulling the hammer back. For every subsequent shot the hammer is automatically cocked by the recoiling bolt carrier. The hammer can be decocked manually without producing a shot and it also can be cocked manually right before the shot. The trigger travel and the pull weight are the same for every shot. A disadvantage of this type of trigger mechanism is the necessity of manually cocking the hammer which involves a risk of an accidental discharge due to letting the hammer fly. Also the time needed for the first shot is longer due to the necessary preliminary operation of cocking the hammer. Carrying of firearms that use this type of trigger mechanism in a condition that allows for a quick first shot, i.e. with the hammer already cocked, requires for a external mechanical safety. Also, prolonged periods of carrying with a cocked hammer result in fatigue of the mainspring, which loses its tension and thus the hammer strikes with less force, which could result in a misfire. Another major disadvantage of this type of trigger mechanism is the impossibility of a second strike on the primer in case of a misfire on the first strike.

In the firearms that use single and double action trigger mechanism the cocking of the hammer for the first shot is done either by pulling the trigger or by cycling the bolt carrier or slide. For every subsequent shot the hammer is automatically cocked by the recoiling bolt carrier. When required the firearm can be put in a safer condition by manually decocking the hammer. This type of trigger mechanism allows for a safe carry of a firearm that is ready for a quick first shot, with a disadvantage being that for the first shot the trigger has a long travel with a relatively heavy pull weight, and for the subsequent shots the travel is short with a light pull weight. The long travel and heavy pull weight lead to difficulties in keeping the sights on the target and low accuracy of the first shot, the one that is considered the most important in a situation of an inevitable self-defense.

In the firearms that use double action only trigger mechanisms the hammer is cocked by pulling the trigger for each and every shot, and it cannot stay cocked on its own. In this type of trigger mechanisms after the bolt carrier cycles during recoil the hammer is automatically lowered and held by a safety notch without producing a shot. The firearms with this type of trigger mechanisms don't need external mechanical safeties, with a disadvantage being the long trigger travel and heavy pull weight that impedes making accurate shots.

Another disadvantage of those major types of trigger mechanisms that use a hammer is the necessity of a hole for the hammer to pass through in the rear part of the frame-grip and slide, which allows for dirt and litter to enter the gun mechanism.

The second major type of trigger mechanisms is the one with a concealed striker, where the striker is directly acted upon by the mainspring, which is either coiled around it or behind it. The trigger mechanisms with a concealed striker are further divided into two sub-types: single action and double action only.

In the single action trigger mechanism that uses a striker, the striker is cocked during the first cycling of the bolt carrier or slide of the firearm which is also used to chamber the first round, and the mainspring at this point is fully compressed. The trigger travel is short and the pull weight is light and those are the same for each shot. A disadvantage of this know type of trigger mechanism is that carrying the firearm with a round chamber can only be done with a compressed mainspring, which causes mainspring fatigue over long periods, and needs additional safety mechanism to prevent accidental discharge. The manual cocking or decocking of the striker is impossible.

In firearms that use a striker and a double action only trigger mechanism the striker has no relation to the movement of bolt carrier or slide. It is cocked only by pulling the trigger, which has a constant long travel and heavy pull weight for every shot. In this type of trigger mechanism the trigger pull weight is lighter compared to the double action of a trigger mechanism with a hammer, because the trigger acts directly on the mainspring. Firearms that use this type of trigger mechanism don't need an external mechanical safety. A disadvantage of this type of trigger mechanism is the impossibility of producing quick subsequent shots.

In terms of technical implementation the closest known trigger mechanism is the one found in the GLOCK [3] family of handguns, which consists of a striker mechanism connected to a trigger mechanism. The striker mechanism includes a striker, lying in a tiered channel formed in the rear part of the slide of the gun, coaxial to the barrel. The striker is shaped like a pin with two enlargements—a front one and a rear one. In front of the front enlargement there is a pointed tip for piercing the primer of the chambered round, and on the rear enlargement there is a prong that links it to the trigger mechanism. Between the two enlargements there is an axially floating ring with external diameter greater than the external diameter of the front enlargement. In the rear part of the tiered channel there is a fixed bushing with a longitudinal channel in its lower part that allows for the prong of the striker to move through. The internal diameter of that bushing is greater than the external diameter of the rear enlargement of the striker so that the striker is able to move axially into the tiered channel and the fixed bushing. There is a coil mainspring around the striker, and its front end pushes the ring against the front enlargement while its rear end rests against the frontal face of the bushing that is fixed into the rear part of the tiered channel, and thus it pushes the striker forward and into the front part of the tiered channel.

The trigger mechanism consists of a trigger that is located below the area of the barrel and it pivots on an axis affixed in the walls of the frame-grip. There is a trigger bar which front end is connected to the trigger and pivots on it, and on its rear end it has a sear that engages the prong of the striker and there is also spring that pulls the trigger at its rear position. It is a coil spring which front end is connected to the trigger bar and its rear end is connected to the rear part of the frame-grip. In the rear end, in the area below the slide of the handgun there is a spring-type stop, which is an angled lamella, on the surface of which the trigger bar can slide down at the end of its backward movement. The slide has a ramp that pushes the spring-type stop aside. The trigger is pushed to the front by the main spring when the striker is cocked.

The problem of this known type of trigger mechanism is that when carrying the gun with a round chambered the mainspring is compressed which causes its fatigue over time.

Another problem of this known type of trigger mechanism is that in order to achieve the desired level of safety it is required that there are three safety mechanisms: a striker safety, a trigger safety, and trigger bar safety. This known type of trigger mechanism doesn't allow for a second attempt to fire by pulling the trigger again in case of misfire due to faulty primer of the round.

The aim of this invention is to create a simple and long-lasting double action striker-trigger mechanism with short reset which can provide a high degree of safety when carrying the firearm with a round chambered and ready to fire and allow for a second pull of the trigger in order to fire in case of a misfire, and to be capable of fast and accurate follow-up shots, with equal trigger weight for all shots.

SUMMERY OF THE INVENTION

The problem is solved by double action trigger mechanism with short reset according the invention that consists of a striker mechanism connected to a trigger mechanism, and the striker mechanism includes a striker lying in a tiered channel coaxial to the barrel that is formed in the rear end of the slide or bolt carrier of the firearm. The striker is shaped like a pin with two enlargements—a front one and a rear one. In front of the front enlargement there is a pointed tip for piercing the primer of the chambered round, and on the rear enlargement there is a prong that links it to the trigger mechanism. Between the two enlargements there is an axially floating ring with external diameter greater than the external diameter of the front enlargement. In the rear part of the tiered channel there is a fixed bushing with a longitudinal channel in its lower part that allows for the prong of the striker to move through. The internal diameter of that bushing is greater than the external diameter of the rear enlargement of the striker so that the striker is able to move axially into the tiered channel and the fixed bushing. The tiered channel is covered by a lid located behind the bushing. The coil mainspring is located around the striker and the trigger mechanism of the firearm consists of a trigger that is found below the area of the barrel and it pivots on an axis affixed in the walls of the frame-grip. There is a trigger bar which front end is connected to the trigger and pivots on it, and on its rear end it has a sear that engages the prong of the striker and there is also spring that returns the trigger at its original position. In the area below the slide there is an angled spring-type stop with two curved edges that allow the trigger bar to slide downwards at the end of its rearward movement. The slide has a ramp that pushes the spring-type stop aside. The striker has a middle enlargement that is closer to the front enlargement. The rear face of the middle enlargement serves as a forward rest of the mainspring and its front face serves as a rear rest of a safety spring that is weaker than the mainspring and whose front end rests against the rear face of the axially floating ring with internal diameter smaller than the external diameter of the front and middle enlargements and its external diameter is greater than the external diameter of the front enlargement. Between the rear end of the mainspring and the bushing there is a second axially floating ring which inside diameter is smaller than the external diameter of the rear and middle extensions. The trigger return spring pushes the trigger forward and the trigger bar up.

The spring that pushes the trigger forward and the trigger bar up can be implemented as a torsion spring built into the trigger that is coiled around the axis the trigger pivots on.

The spring that pushes the trigger forward and the trigger bar up can also be implemented as a coil spring that has its one end connected to the rear part of the frame-grip and its other end connected at an angle to the rear part of the trigger bar.

The spring that pushes the trigger forward and the trigger bar up can also be implemented as two separate springs—one that pushes the trigger forward and one that pushes the trigger bar up.

The advantages of the double action striker-trigger mechanism with short reset that is the purpose of this invention are the following:

This mechanism is simplified due to dropping out the necessity of having three safeties because it is impossible to have an accidental discharge with it because of the implementation of the trigger and striker mechanisms that are engaging each other by the sear of the trigger bar and the prong of the striker which have matching profiles and thus block the movement of the striker forward. In this case the trigger bar acts as an internal automatic safety which is disengaged in the moment when the trigger reaches its rearmost position and is engaged when the trigger is allowed to return forward. Also the firing pin is always fully decocked and the mainspring fully decompressed, except when the trigger is pulled, which is major safety advantage.

Another advantage of the double action striker-trigger mechanism with short reset is the option to safely carry the firearm with a round chambered for prolonged periods of time because the mainspring is directly compressed only by pulling the trigger.

Due to the mainspring not being compressed with a round chambered its wears out to a lesser degree and the service life of the firearm is longer, and makes the firearm absolutely safe.

An important contribution to the current state of technology is the combination of the double action trigger with the short reset which gives the firearm the high level of safety associated with double action systems and the possibility of firing quick subsequent shots that is a feature of the single action systems.

What this means is that after the slide or bolt carrier recoil back due to the shot, in order to fire the next shot it is sufficient that the trigger is only lightly released and pulled again. If the shooter decides not to continue firing, the safety mechanism will be automatically engaged with the release of the trigger.

An advantage of this double action striker-trigger mechanism with short reset is the possibility of multiple subsequent strikes in order to fire a round with a faulty primer in case of a misfire, which is an important feature for a military service weapon.

SHORT DESCRIPTION OF THE FIGURES

A preferred example of implementation of the double action trigger mechanism according to this invention is shown on the closed figures as follows.

EMBODIMENTS OF THE INVENTION

Figure 1:
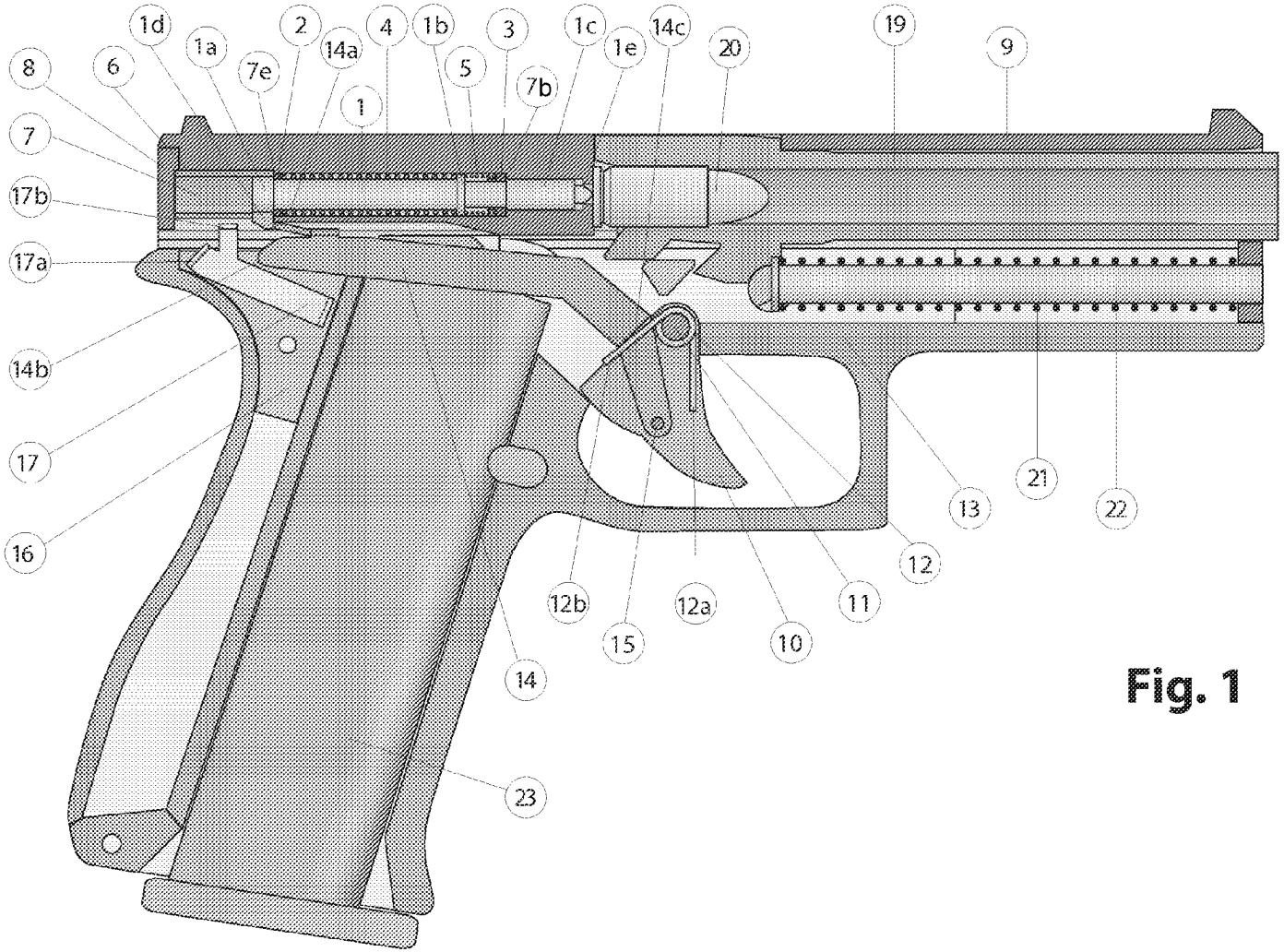
FIG. 1 represents a vertical cross section of a semi-automatic firearm with double-action trigger with short reset, in a stationary position of the mechanism and with a chambered round.
Figure 13A:
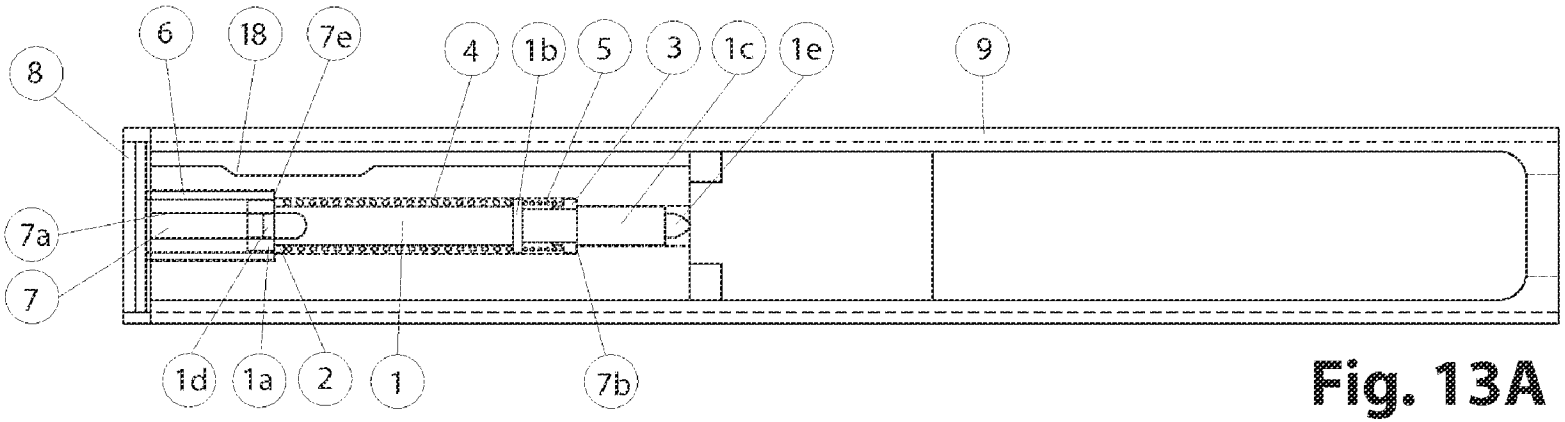
FIG. 13A represents a bottom view of the slide of a disassembled semi-automatic firearm with double-action trigger with short reset.
Figure 13B:
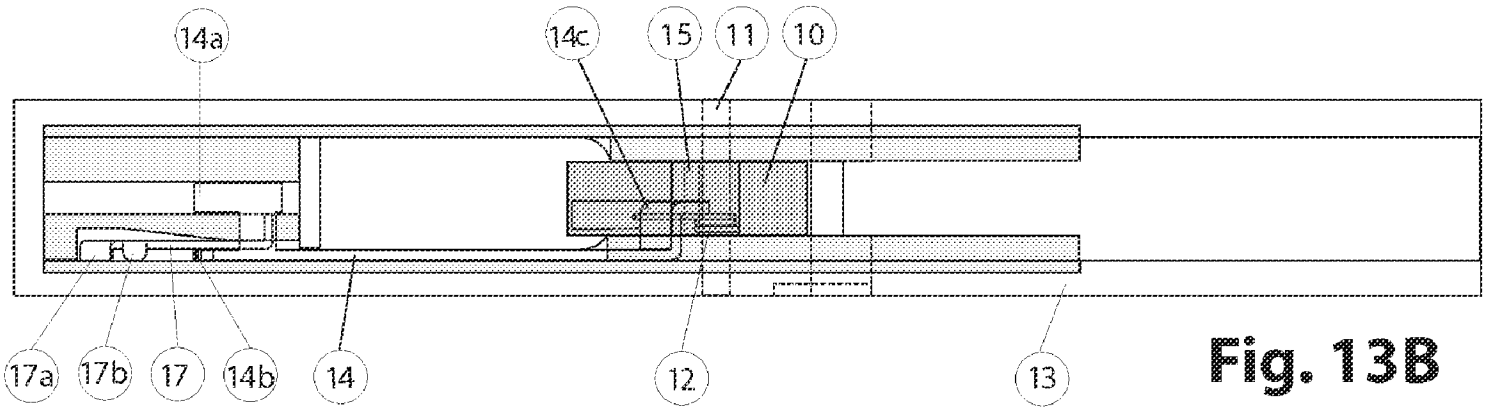
FIG. 13B represents a top view of the frame-grip of a disassembled semi-automatic firearm with double-action trigger with short reset.
Figure 15:
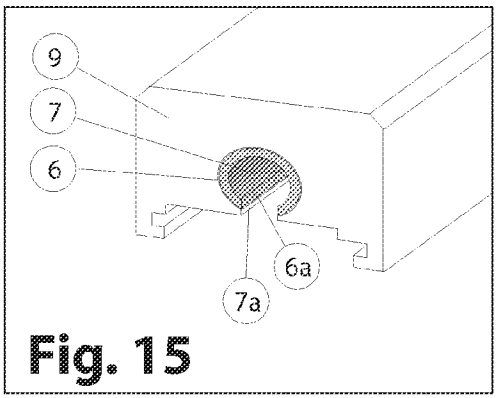
FIG. 15 represents a 3-dimensional vertical cross section of the slide of a semi-automatic firearm with double-action trigger with short reset through the rear part of the slide, the tiered channel and the bushing in it.
Figure 16:
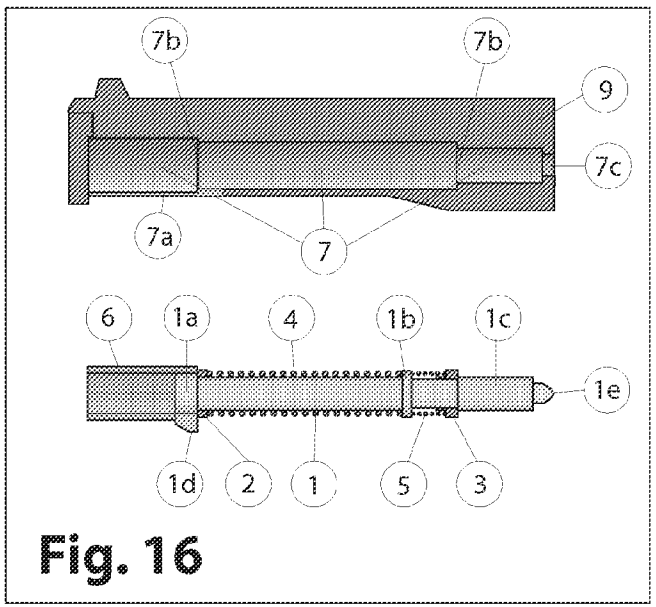
FIG. 16 represents a vertical longitudinal section of the rear part of the slide of a semi-automatic firearm with double-action trigger with short reset through the tiered channel and with the striker mechanism removed.
Figure 14B:
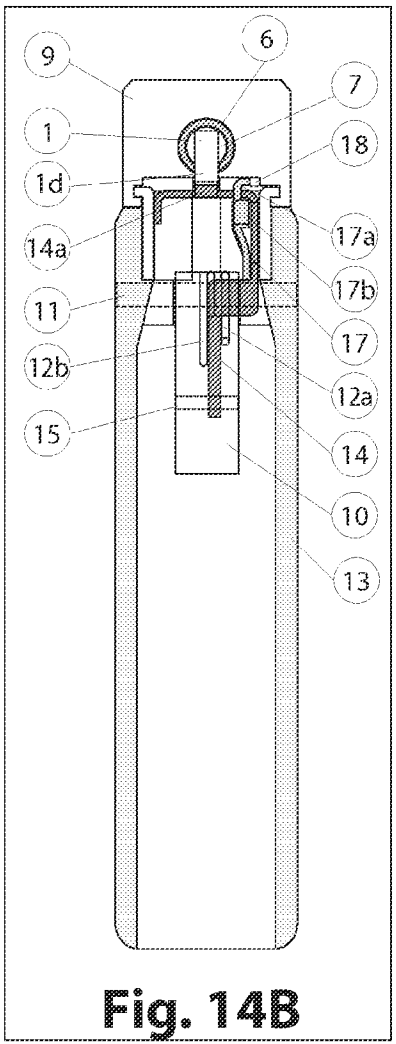
FIG. 14B represents a rear view of a vertical cross section of the trigger mechanism of a semi-automatic firearm with double-action trigger with short reset with the trigger fully depressed, a shot fired, and the slide partially recoiled rearwards.
Figure 14A:
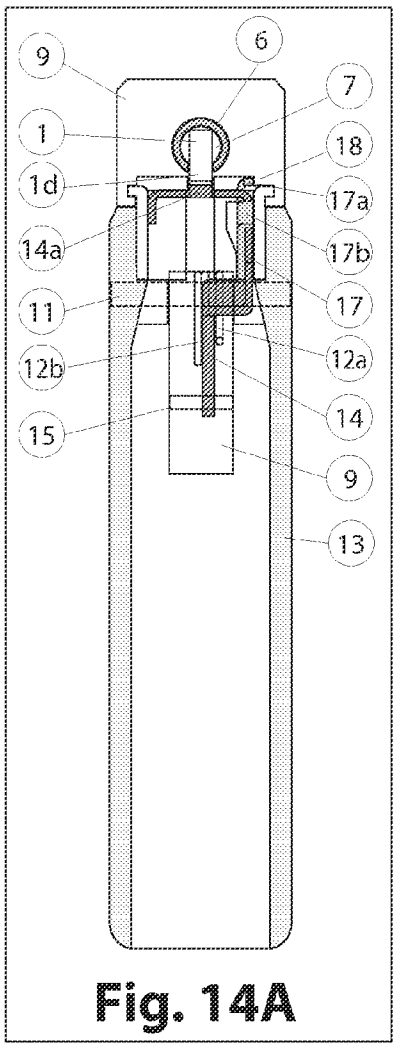
FIG. 14A represents a rear view of a vertical cross-section of the trigger mechanism of a semi-automatic firearm with double-action trigger with short reset in a stationary position with the trigger at rest.

FIG. 1 shows a vertical cross section of an automatic firearm—a handgun, in a stationary position of the mechanism, which has a built-in double-action trigger mechanism with short reset, according to the subject of the current invention. The double-action trigger mechanism with short rest consists of striker (1) with three enlargements—rear (1*a*), middle (1*b*), and front (1*c*). The front (1*c*) and rear (1*a*) enlargements are positioned at the two ends of the striker (1). The middle enlargement (1*b*) is positioned closer to the front enlargement (1*c*). There is a prong (1*d*) formed on the bottom end of the rear enlargement (1*a*) to connect the striker to the trigger mechanism. The prong (1*d*) has a flat frontal face, perpendicular to the axis of the striker (1), and a rear face inclined to the axis of the striker (1). In the front part of the striker (1), centered on the front enlargement, is formed a pointed tip (1*e*). Between the rear enlargement (1*a*) and the front enlargement (1*c*) there are two axially floating rings (2 and 3), whose inner diameter is smaller than the outer diameter of the enlargements 1*a* and 1*c*, so that their axial movement is restricted by them. A coil mainspring (4) is wrapped around the striker (1). The rear end of the mainspring (4) rests against the front face of the rear floating ring (2), and its front end rests against the rear face of the middle enlargement (1*b*). Against the front face of the middle enlargements (1*b*) rests the rear end of a safety spring (5), whose front end rests against the rear face of the front floating ring (3). The safety spring (5) is weaker than the mainspring (4). The rear face of the rear floating ring (2) rests against the front face of a bushing (6). The tiered channel (7) is closed by a lid (8) and has a longitudinal cut (7*a*) (FIG. 13A, 15, and 16), formed in its lower rear end, parallel to its longitudinal axis. In this longitudinal cut (7*a*) lies the prong (1*d*) of the rear enlargement (1*a*) of the striker (1), and this prong (1*d*) is positioned so that it extends outside of the longitudinal cut (7*a*). The tiered channel (7) is narrower in its front part, so that a tiered narrowing (7*b*) is formed, which has its smallest diameter in its front part, and it ends with an opening (7*c*) to allow passing through of the frontal pointed tip (1*e*) of the striker (1). The bushing (6) is placed in the rear, widest part of the tiered channel (7) and it provides rear support for the floating ring (2) when cocking the striker (1). The rear narrowing (7*e*) of the tiered channel (7) and the lid (8) fix the bushing (6) and restrict it from moving (FIG. 1). In the zone of the longitudinal cut (7*a*) there is a longitudinal cut (6*a*) formed in the bushing (6), which is as wide as the longitudinal cut (7*a*) at the rear part of the tiered channel (7) and coincides with it so that the prong (1*d*) of the striker can move freely along its longitudinal axis (FIGS. 14A and 15). The outer diameter of the bushing (6) is equal to the diameter of the rear and widest part of the tiered channel (7), and its inside diameter is slightly larger than the diameter of the rear enlargement (1*a*) of the striker (1), so that it can pass freely through it and the striker (1) can move freely along its axis (FIG. 1 to 9).

The trigger mechanism shown on FIGS. 1 to 9 consists of a trigger (10) on a pivot (11). Around the pivot (11) there is a torsion spring (12) which returns the trigger (10) forward. The front arm (12*a*) of the torsion spring (12) pushes the trigger (10) forward to the frame (13), and the rear arm (12*b*) pushes the trigger bar (14) at its curve (14*c*) up towards the slide (9) and the prong (1*d*) of the striker (1). In the lower part of the trigger (10) is placed a pivot (15), which the trigger bar (14), shaped as a profiled single-arm lever, pivots on.

At the upper rear part of the trigger bar (14) is formed a sear (14*a*), which serves to engage the prong (1*d*) of the striker (1). The sear (14*a*) of the trigger bar (14) has a rear face perpendicular to the axis of the striker, and an inclined frontal face, matching the inclined plane of the prong (1*d*) of the striker (1).

The rear end of the trigger bar (14) has a curved downwards profile (14*b*), which serves to guide the trigger bar (14) downwards and keep it there when the trigger (10) is fully depressed, which works due to a spring-type stop mounted inside a cut formed in a rear block (16), designed as a single leaf spring with two curved edges, which keeps a constant pressure in the direction of the trigger bar (14) and its adjacent wall of the frame-grip (13). The rear curved edge (17*a*) serves to interact with the curved profile (14*b*) of the trigger bar (14), and the upper curved edge (17*b*) interacts with a ramp (18) formed on the bottom rear part of the slide (9) (FIGS. 12A, 12B, 13A 14A and 14B).

In the front part of the frame-grip (13) there is a barrel (19) with a chamber formed at its rear, made for chambering a round (20). Below the barrel (19), in the front part of the frame-grip (13) there is a coil-type recoil spring (21) wrapped around a spring guide (22). Behind the spring guide (22) is the trigger mechanism, connected with the striker mechanism in the upper rear end of the slide (9), under which, in the grip, is the magazine (23) (FIG. 1).

The double-action trigger mechanism with short reset works as follows:

The semi-automatic firearm with built-in double-action trigger mechanism with short reset, according to the subject of the current invention, is loaded by manually pulling the slide (9) to its rearmost position, followed by letting it return forward, during which a round (20) is introduced into the rear end of the barrel (19).

After that the trigger (10) is depressed, and by that, a shot is produced. Under the reactive force (recoil) of the shot the slide (9) moves backwards, ejecting the empty shell of the fired round (20). Under the tension of the recoil spring (21) the slide (9) returns forward, stripping a new round (20) from of the magazine (23) and introducing it into the barrel (19).

In the stationary position of the mechanism of the semi-automatic firearm, shown on FIG. 1, the sear (14*a*) of the trigger bar (14) of the trigger mechanism is positioned in front of the prong (1*d*) of the striker (1) and so it serves as a safety device. In this position no shot can be produced.

In this position, as shown on FIG. 1, the mainspring (4) of the striker (1) pushes both the rear axially floating ring (2) backwards and the middle enlargement (1*b*) forward at the same time, and the safety spring (5) pushes both the middle enlargement (1*b*) backwards and the front axially floating ring (3) forwards. In this case the rear axially floating ring (2) rests against the frontal face of the bushing (6) and the rear enlargement (1*a*) of the striker (1), and the front axially floating ring (3) rests against the rear face of the tiered narrowing (7*b*) in the tiered channel (7) of the slide (9) and the front enlargement (1*c*) of the striker (1). The rear enlargement (1*a*) and the middle enlargement (1*b*) of the striker (1) restrict the maximum stretching of the mainspring (4), and the front enlargement (1*c*) and the middle enlargement (1*b*) of the striker (1) restrict the maximum stretching of the safety spring (5). So the two rings (2 and 3) accordingly push the rear enlargement (1*a*) of the striker (1) rearwards and the front enlargement (1*c*) forwards, thus keeping the striker (1) stationary.

Figure 2:
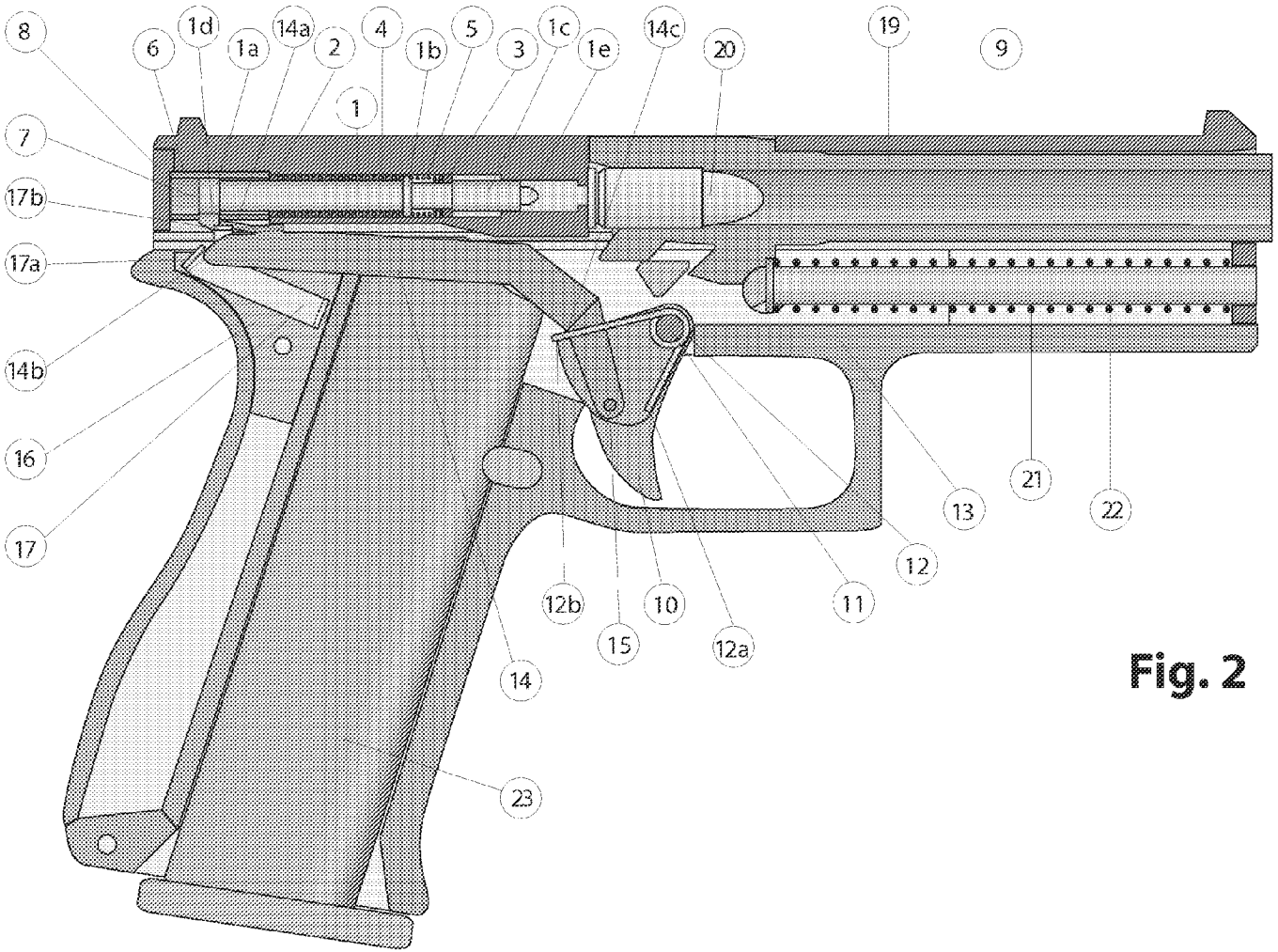
FIG. 2 represents a vertical cross section of a semi-automatic firearm with double-action trigger with short reset, with the trigger fully depressed, immediately before a shot is fired.
Figure 3:
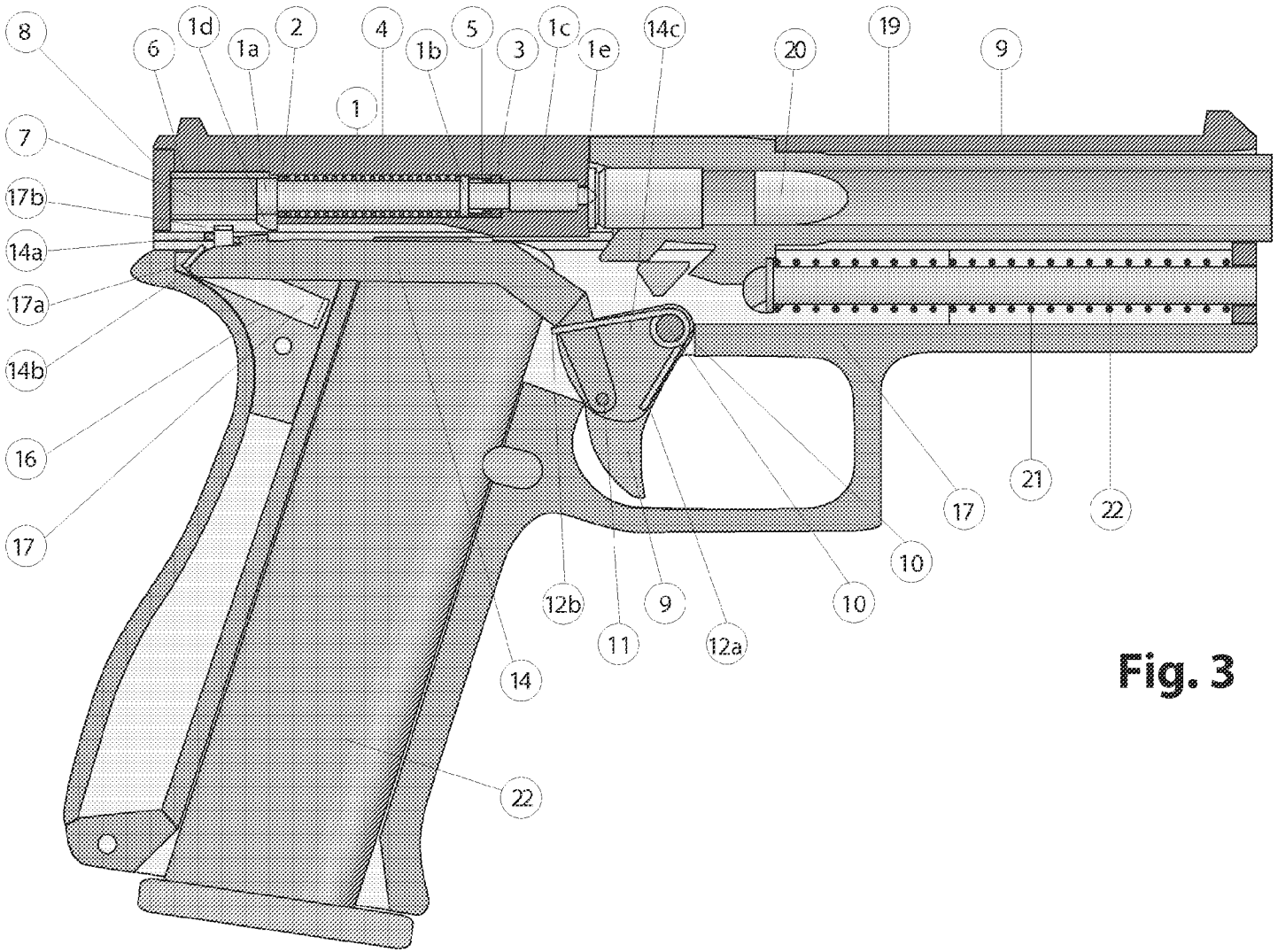
FIG. 3 represents a vertical cross section of a semi-automatic firearm with double-action trigger with short reset, at the moment of the shot.
Figure 4:
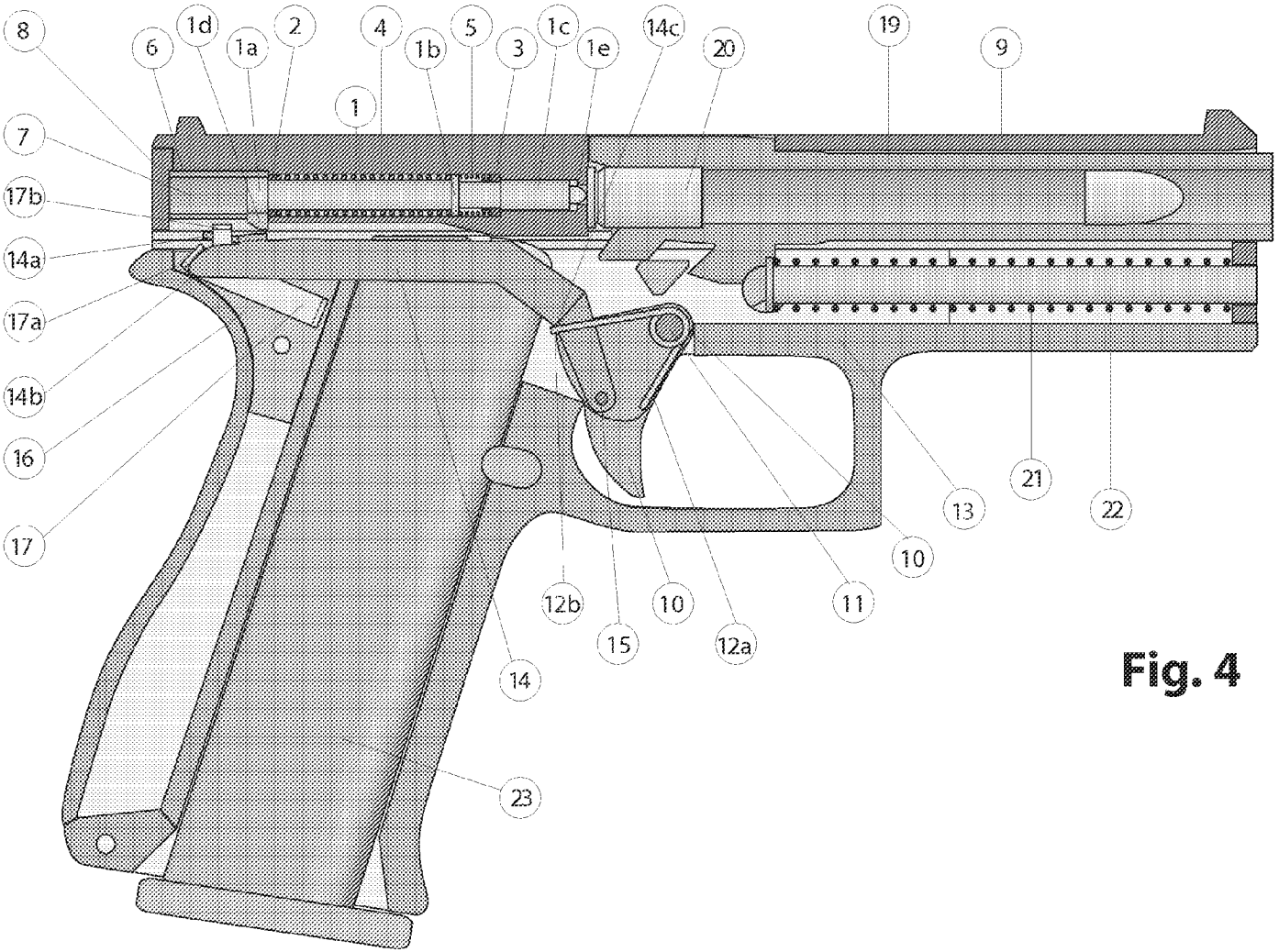
FIG. 4 represents a vertical cross-section of a semi-automatic firearm with double-action trigger with short reset, immediately after a shot is fired, before the bullet has left the barrel.

With the depressing of the trigger (10) the trigger bar (14) moves backwards, and the sear (14*a*) pushes the prong (1*d*) of the striker (1), cocking it along with the mainspring (4), as shown on FIG. 2. In the moment when the curved profile (14*b*) of the trigger bar (14) reaches the spring-type stop (17), the shooter will feel a second step in the trigger pull, after which the trigger (10) pull weight will slightly increase.

As the striker (1) is being cocked, its middle enlargement (1*b*) pushes against the mainspring (4) and compresses it, pushing it against the rear axially floating ring (2), resting against the bushing (6). The mainspring (4) is being compressed until the rear curved profile (14*b*) of the trigger bar (14) slides down the curved edge (17*a*) of the spring-type stop (17) and is deflected downwards, and because of this the sear (14*a*) of the trigger bar (14) releases the prong (1*d*) of the striker (1) and the striker (1), under the tension of the mainspring (4), flies forward, as shown on FIG. 3.

As the striker (1) moves forward under the tension of the fully compressed mainspring (4), the mainspring (4) pushes the middle enlargement (1*b*) of the striker (1), thus forcing it forward until the point where the rear floating ring (2) reaches the rear enlargement (1*a*) of the striker (1). The front floating ring (3), pushed against the front enlargement (1*c*) of the striker (1) by the safety spring (5) moves forward along with the striker (1) until it reaches the rear face of the front tiered narrowing (7*b*) of the tiered channel (7). At this moment the front floating ring (3) stops its axial movement in the channel (7), and the striker (1) continues to move forward due to its inertia and with its middle enlargement (1*b*) compresses the safety spring (5) until the pointed tip (1*e*) of the striker hits the primer of the round (20) in the barrel (19). In this moment a shot is fired, as shown on FIG. 3. During the inertial movement of the striker the rear floating ring (2) rests again the rear enlargement (1*a*) of the striker (1) and moves along with it. The safety spring (5), being compressed by the movement of the striker (1) under its momentum, pushes the middle enlargement (1*b*) backwards and moves it towards the front face of the bushing (6), thus returning the striker (1) in its original position, shown on FIG. 4 and previously described as a stationary position of the striker (1).

After the shot, under the influence of the reactive force (recoil) the slide (9) flies backwards, ejecting the shell of the fired round (20).

Figure 5:
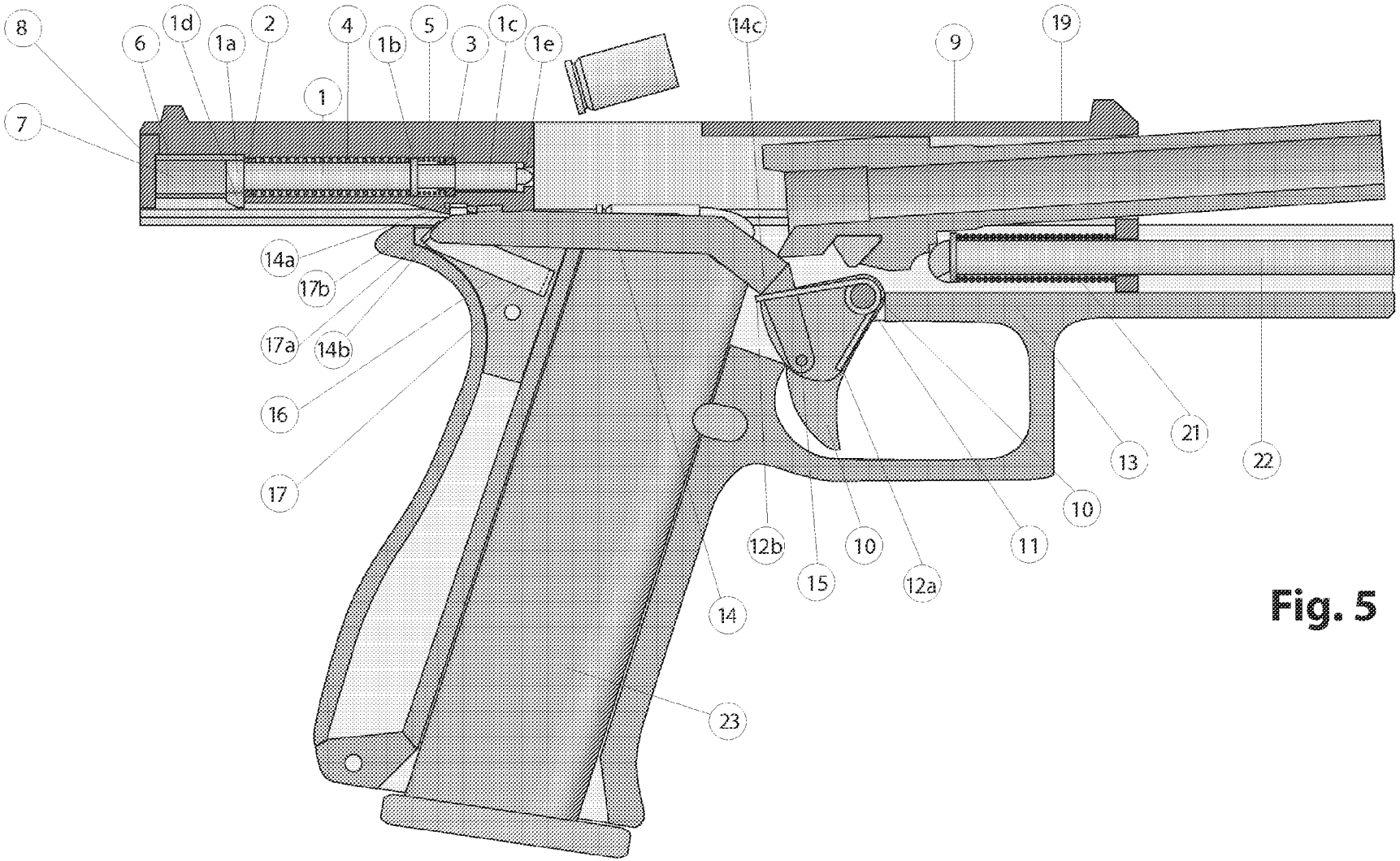
FIG. 5 represents a vertical cross section of a semi-automatic firearm with double-action trigger with short reset, at the moment when the slide has reached its rearmost position due to the recoil of the weapon.

During the slide's (9) backwards motion, the ramp (18) on the slide (9) pushes the upper curved edge (17*b*) of the spring-type stop (17), bending it, so that the rear curved edge (17*a*) of the stop (17) moves aside of the curved profile (14*a*) of the trigger bar (14) (FIGS. 12B and 14B) and the curved profile (14*a*), under the tension of the rear arm (12*b*) of the trigger (10) spring (12), moves upwards (FIG. 5).

Figure 6:
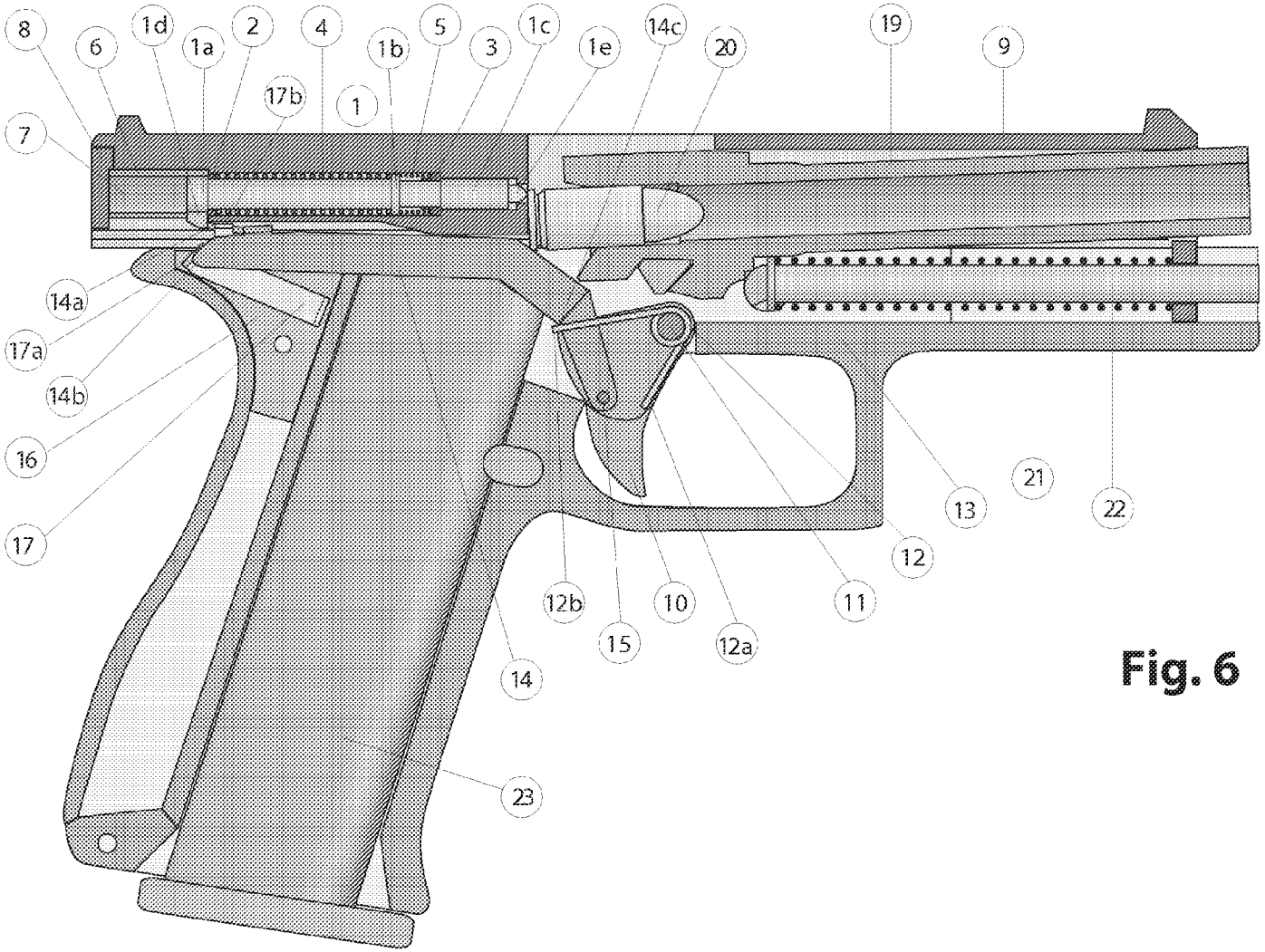
FIG. 6 represents a vertical cross section of a semi-automatic firearm with double-action trigger with short reset, during the reloading cycle when the trigger bar engages the striker, and the slide had stripped a round from the magazine and introduces it into the chamber.
Figure 7:
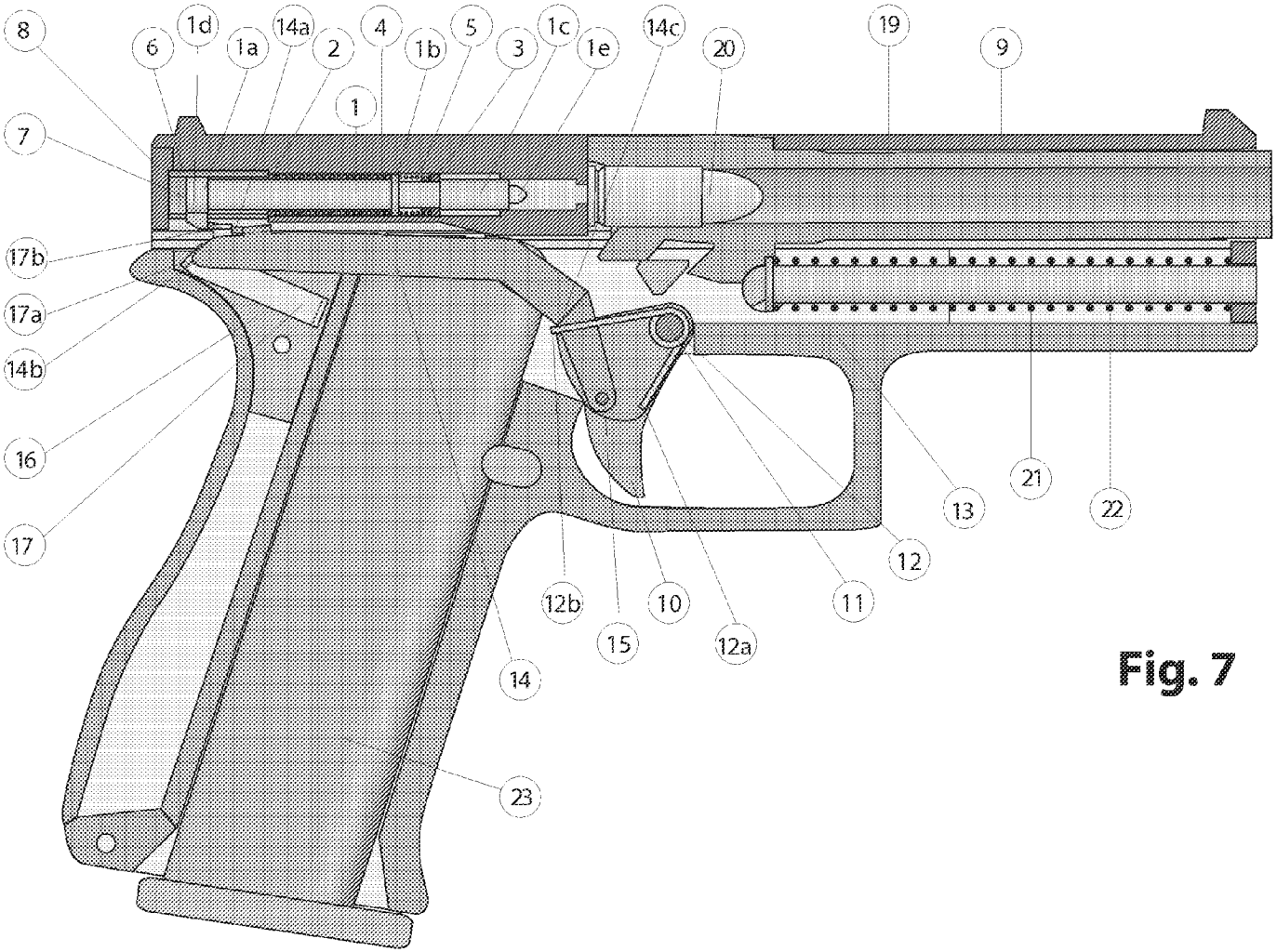
FIG. 7 represents a vertical cross section of a semi-automatic firearm with double-action trigger with short reset, when the reloading cycle has completed and the striker is fully cocked and under tension by the mainspring.

The rearward motion of the slide (9) continues until it reaches its rearmost position. Then, under the tension of the recoil spring (21) the slide (9) starts to move forward, stripping a new round (20) from the magazine (23) and introducing it into the chamber of the barrel (19). During this forward motion of the slide (9) the prong (1*d*) of the striker (1*d*) engages the sear (14*a*) of the trigger bar (14), thus blocking the movement of the striker (1) and it stops (FIG. 6). The slide (9), under the tension of the recoil spring (21), which is much stronger than the mainspring (4), continues its forward motion, compressing the mainspring (4), as shown on FIG. 7. The mainspring (4) is being compressed until the slide (9) reaches its foremost position (FIG. 7).

Figure 8:
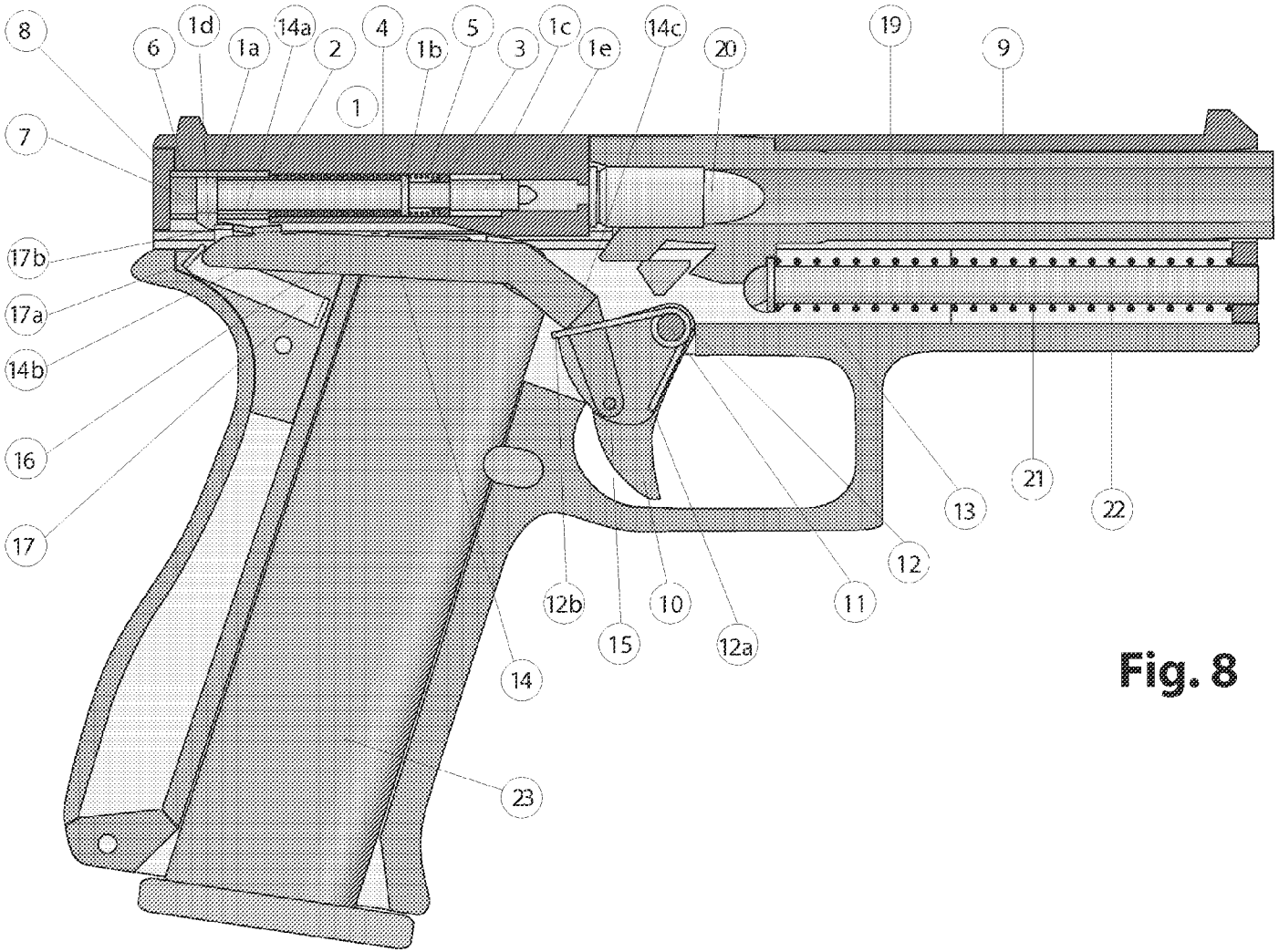
FIG. 8 represents a vertical cross section of a semi-automatic firearm with double-action trigger with short reset, with the trigger slightly released, being ready for the next shot.
Figure 9:
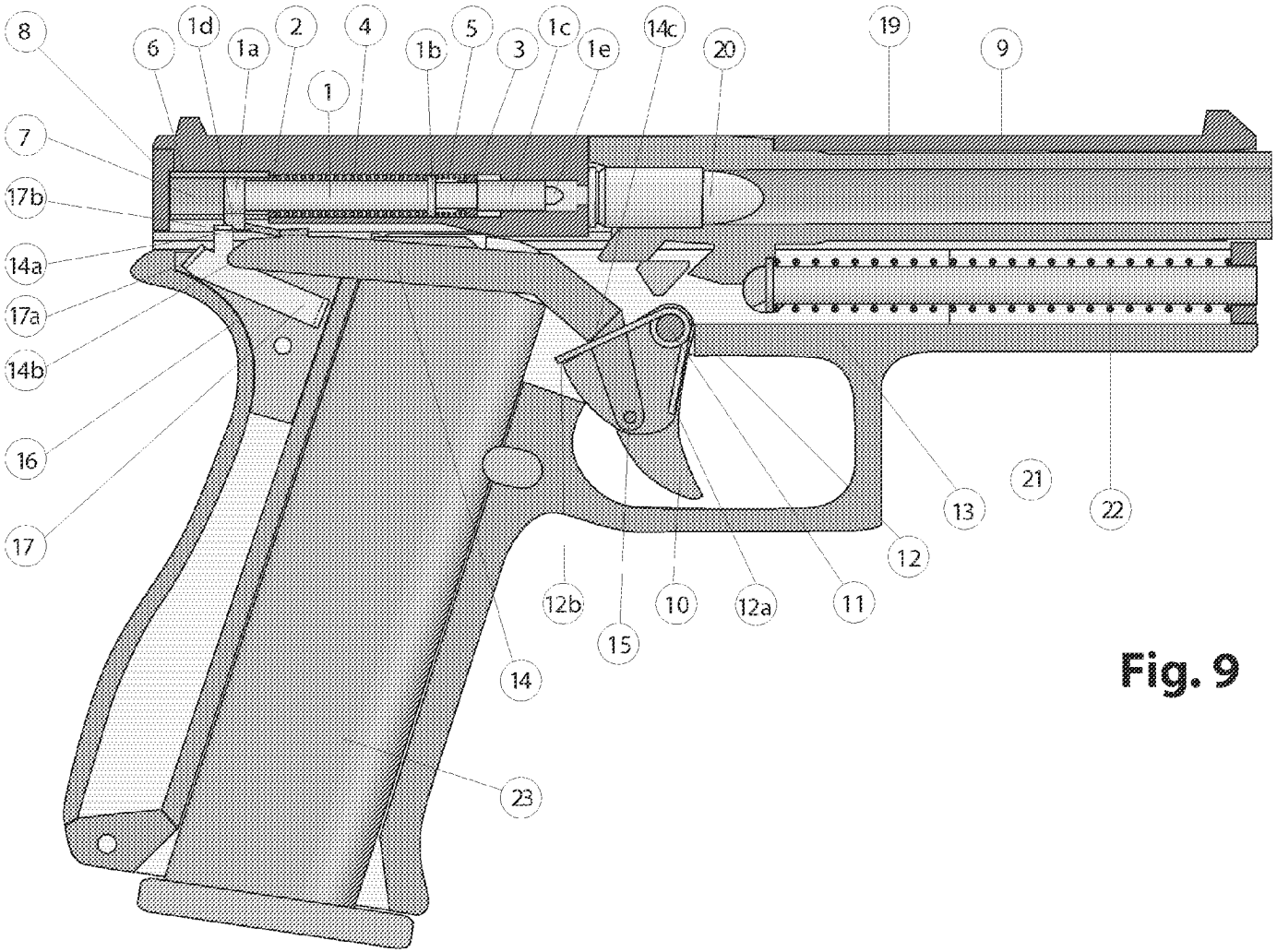
FIG. 9 represents a vertical cross section of a semi-automatic firearm with double-action trigger with short reset, in the moment when trigger is released forward, and the striker and the mainspring are decocked.
Figure 12A:
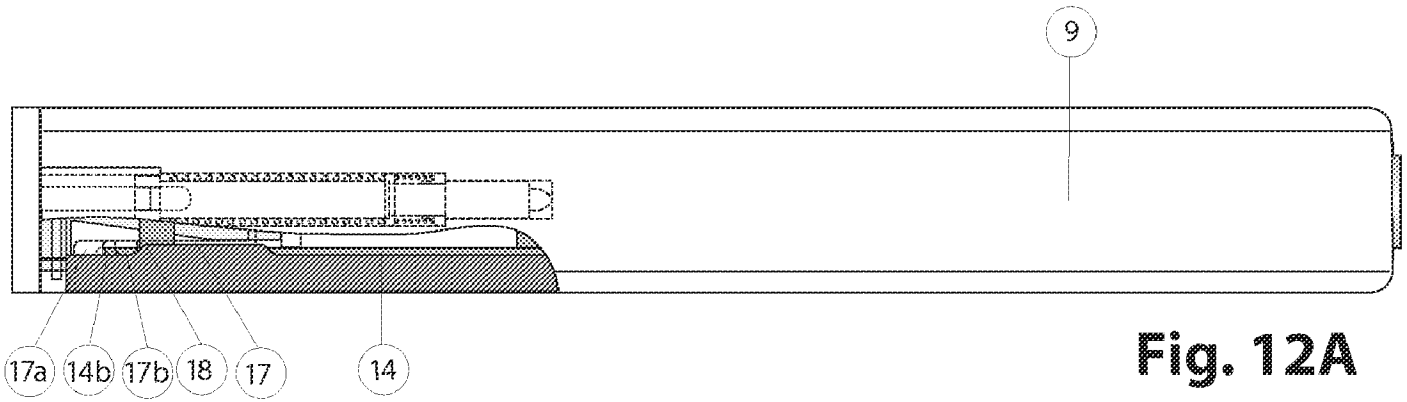
FIG. 12A represents a top view of a partial horizontal cross section of a semi-automatic firearm with double-action trigger with short reset, with the slide fully closed in its foremost position.
Figure 12B:
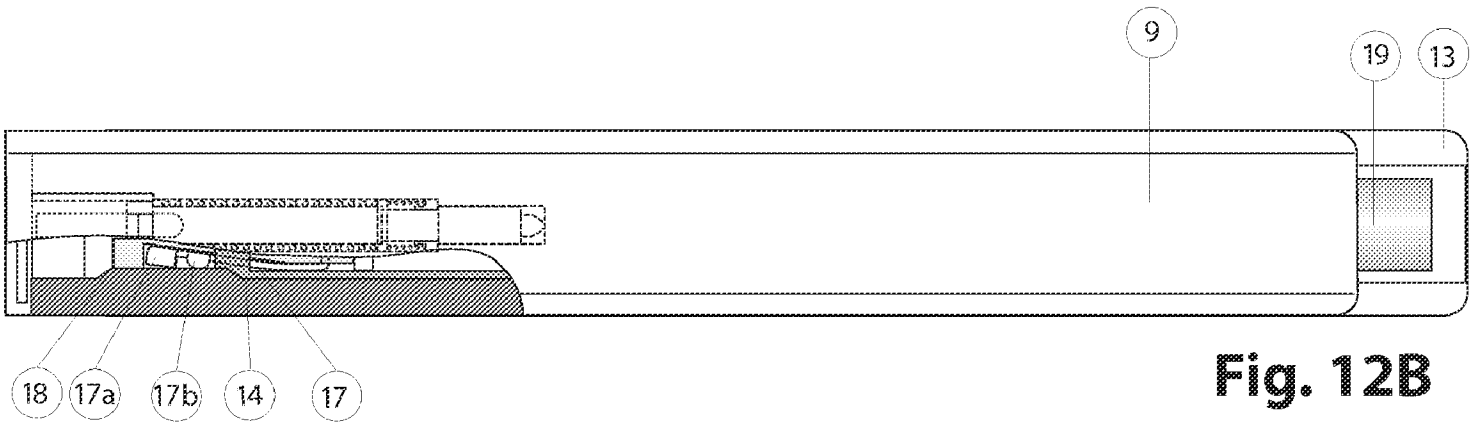
FIG. 12B represents a top view of a partial horizontal cross section of a semi-automatic firearm with double-action trigger with short reset, at the moment after a shot is fired, with the slide partially recoiled rearwards.

With a slight release of the trigger the curved profile (14*b*) of the trigger bar (14) moves forward, enabling the rear curved edge (17*a*) of the spring-type stop (17) to moves into its original position (FIGS. 8, 12A and 14A). In this position the semi-automatic firearm is ready for the next shot. What is needed is that the trigger (10), without being released any further, to be fully depressed again and the previously described cycle will repeat.

When the shooting is ceased, and the finger is removed from the trigger (10) it, under the tension of the trigger spring (12) and the mainspring (4), will return to its foremost position, as shown on FIG. 1. Simultaneously with the trigger (10) returning forward the mainspring (4) is being released (FIG. 9) until it reaches its stationary position, as shown on FIG. 1.

Figure 10:
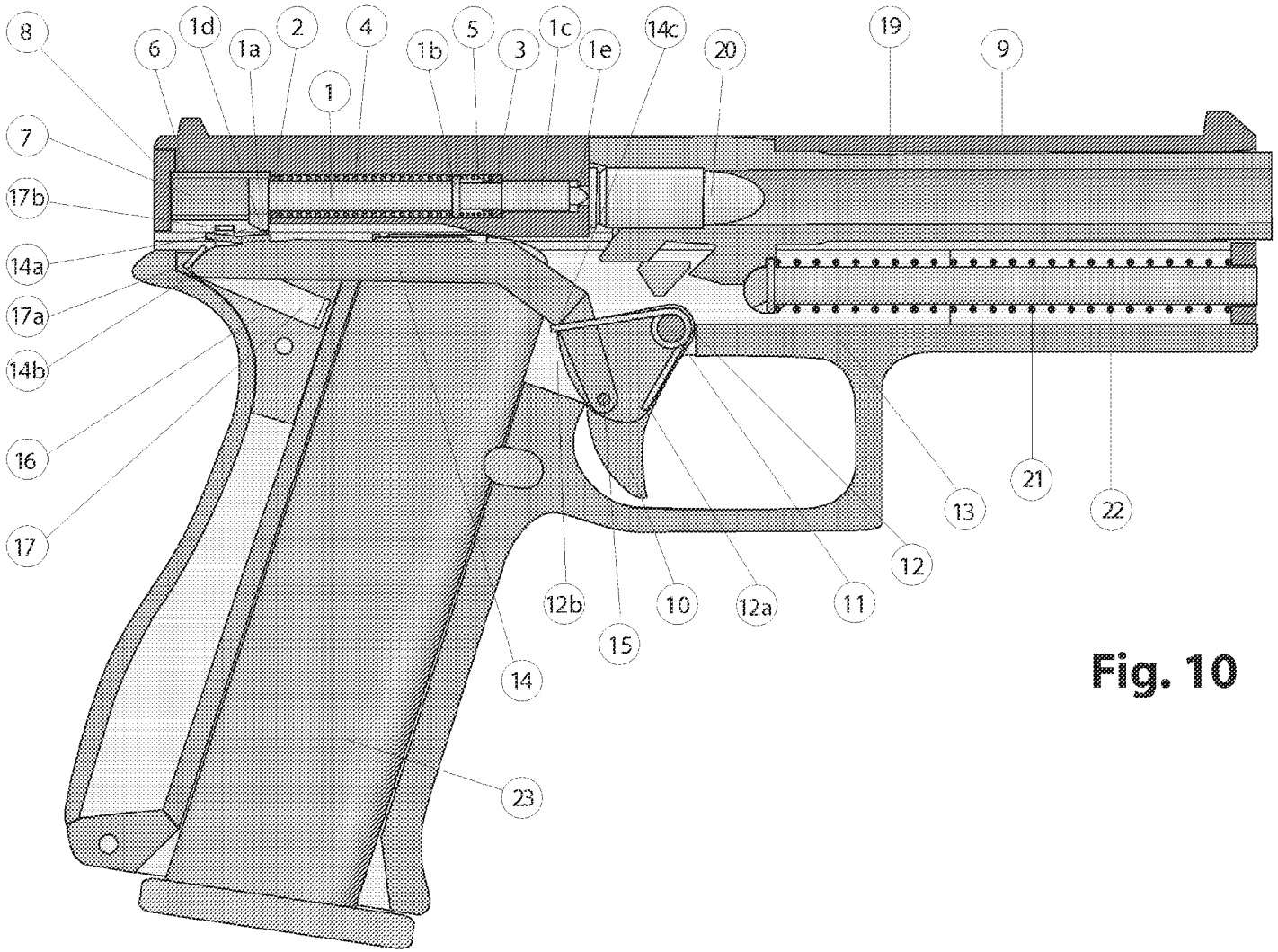
FIG. 10 represents a vertical cross section of a semi-automatic firearm with double-action trigger with short reset, with the trigger depressed in the case of a failure to fire due to a faulty primer of the round.
Figure 11:
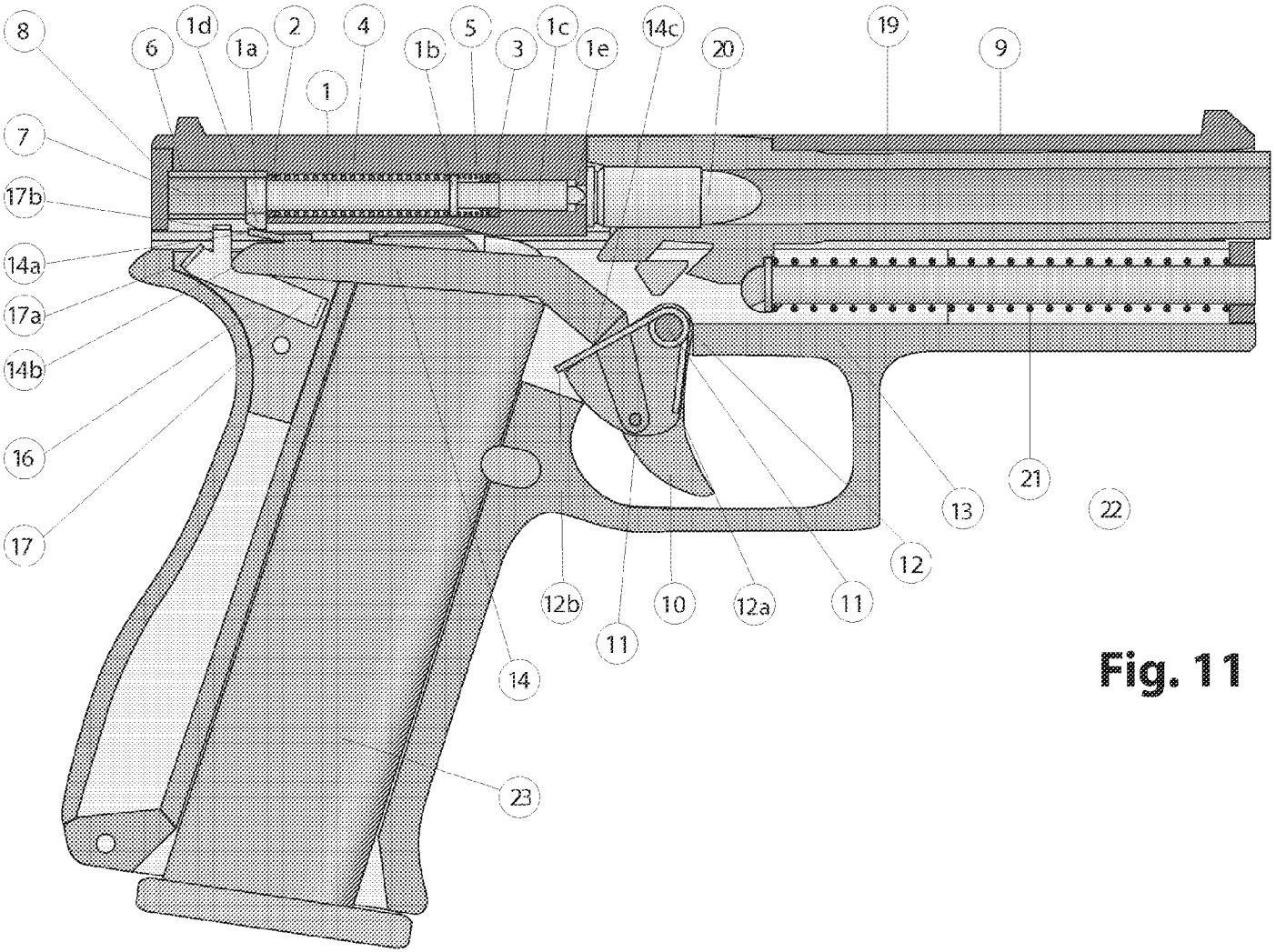
FIG. 11 represents a vertical cross section of a semi-automatic firearm with double-action trigger with short reset, with the trigger being allowed to return forward, and the sear part of the trigger bar moving below the prong of the striker to get in front of it.

In the case of a misfire due to a faulty primer of the round (20), as shown on FIG. 10, in order to make a second strike on the primer, it is required that the trigger (10) is allowed to return fully forward. It, under the tension of the front arm (12*a*) of the trigger (10) spring (12), will return forward, and by the pivot (15) of the trigger bar (14) will pull the trigger bar (14) forward, and by that movement the upper face of the sear (14*a*) of the trigger bar (14) will slide on the rear inclined face of the prong (1*d*) of the striker (1), which will slightly deflect the trigger bar (14) downwards (FIG. 11), until it clears the prong (1*d*) of the striker (1). After the sear (14*a*) of the trigger bar (14) is in front of the prong (1*d*) of the striker (1), the trigger bar (14) moves up under the tension of the rear arm (12*b*) of trigger spring (12). In this moment the sear (14*a*) of the trigger bar (14) again moves in front of the prong (1*d*) of the striker (1) in its original position, as shown on FIG. 1. It is necessary to fully depress the trigger (10) again in order to be made a second strike on the primer of the round (20).

According to the subject of the this invention of a double-action trigger mechanism with short reset, the trigger bar (14) also doubles as an internal automatic safety. This works in the following way. In each and every position of the trigger (10) (FIG. 1, 2, and from 5 to 9), except in the moment when a shot occurs (FIGS. 3 and 4) when the trigger (10) is fully depressed, the sear (14*a*) of the trigger bar (14) is positioned in front of the prong (1*d*) of the striker (1) and is pushed against it by the rear arm (12*b*) of the trigger spring (12), which means, that even if the almost fully depressed trigger is accidentally released due to a slip or dropping of the firearm, the compressed mainspring (4) will push the trigger bar (14) along with the trigger (10) forward, until the trigger reaches its foremost position in the frame-grip (13). In this moment the continued motion of the trigger bar (14) and the sear (14*a*) forward becomes impossible, and so the sear part (14*a*) of the trigger bar (14), engaging the prong (1*d*) of the striker (1), doesn't allow the striker (1) to move forward any further and reach the primer of the round (20). The so described safety action of the trigger bar (14) and its sear (14*a*) also makes an accidental discharge impossible in the case of the firearm being dropped on the ground, being hit by an object, or used to hit an object with.

CITED DOCUMENTS

[1] U.S. Pat. No. 4,539,889;
[2] U.S. Pat. No. 4,835,744;
[3] U.S. Pat. No. 4,893,546

The invention claimed is:

1. Double action trigger mechanism with short reset, consisting of a striker mechanism connected to a trigger mechanism, the striker mechanism consisting of a striker placed in a tiered channel formed in the rear part of the slide of the firearm and coaxial to the barrel, and the striker shaped like a pin with two enlargements at either end, namely the front enlargement and rear enlargement, as in front of the front enlargement there is a pointed tip that is used to pierce the primer of the chambered round, and on the rear enlargement there is a prong that engages the trigger mechanism, and between the two enlargements there is an axially floating ring with external diameter greater than the external diameter of the front enlargement, and in the rear part of the tiered channel there is a bushing fixed in place with a longitudinal channel in its lower part for the prong of the striker to pass through, and the internal diameter of this bushing is greater than the external diameter of the rear enlargement of the striker so the striker is able to move axially in the tiered channel and the bushing fixed in its rear part, behind which bushing the tiered channel is closed by a lid, a coil mainspring is located around the striker, and the trigger mechanism of the firearm consists of a trigger placed in the area below the barrel that pivots on an axis affixed to a frame-grip of the firearm, and there is a trigger bar which front end is connected to the trigger and pivots on it, and on its rear upper end it has a sear that engages the prong of the striker and there is also spring that returns the trigger at its original position, and in the area below the slide there is an angled spring-type stop with two curved edges that allows the trigger bar to slide downwards at the end of its rearward movement and the slide has a ramp that pushes the spring-type stop to the side, characterized in that the striker (1) has a middle enlargement (1*b*) which is located closer to the front enlargement (1*c*) in such way that the rear face of the middle enlargement (1*b*) serves as a forward rest for the mainspring (4) and its front face serves as a rear rest for a safety spring (5) that is weaker than the mainspring, and the front face of the safety spring (5) rests on the rear face of the front axially floating ring (3) whose internal diameter is smaller than the external diameter of the front (1*e*) and middle (1*b*) enlargements and whose external diameter is greater than the external diameter of the front enlargement (1*c*), as between the rear end of the mainspring (4) and the bushing (6) there is a second rear axially floating ring (2) whose internal diameter is smaller than the external diameter of the rear (1*a*) and middle (1*b*) enlargements, and a spring (12) that returns the trigger (10) is pushing the trigger (10) forward and the trigger bar (14) up.

2. A double action trigger mechanism with short reset according claim 1, characterized in that the spring (12) that pushes the trigger forward and the trigger bar up is implemented as a torsion spring built in the trigger (10) and coiled around the axis (11) it pivots on.

3. A double action trigger mechanism with short reset according claim 1, characterized in that the spring (12) that pushes the trigger forward and the trigger bar up is implemented as a coil spring that is connected to the frame-grip (13) in one end and connected at an angle to the rear part of the trigger bar (14) in the other end.

4. A double action trigger mechanism with short reset according claim 1, characterized in that the spring (12) that pushes the trigger forward and the trigger bar up is implemented as two separate springs—one pushing the trigger (10) forward and the other pushing the trigger bar (14) up.

* * * * *